US010548198B2

(12) United States Patent
Zlotnikov et al.

(10) Patent No.: US 10,548,198 B2
(45) **Date of Patent: *Jan. 28, 2020**

(54) METHODS AND SYSTEMS FOR MAINTAINING THE ILLUMINATION INTENSITY OF LIGHT EMITTING DIODES

(71) Applicant: Luminator Holding LP, Plano, TX (US)

(72) Inventors: Vadim Zlotnikov, Dallas, TX (US); John B. Gunter, Flower Mound, TX (US); Jim Coker, Allen, TX (US); George Berman, Dallas, TX (US); Valeriy K. Berger, Plano, TX (US)

(73) Assignee: Luminator Holding LP, Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/271,233

(22) Filed: Feb. 8, 2019

(65) Prior Publication Data

US 2019/0174597 A1 Jun. 6, 2019

Related U.S. Application Data

(63) Continuation of application No. 15/698,207, filed on Sep. 7, 2017, now Pat. No. 10,231,308, which is a (Continued)

(51) Int. Cl.
*H05B 33/08* (2006.01)

(52) U.S. Cl.
CPC ..... *H05B 33/0854* (2013.01); *H05B 33/0887* (2013.01)

(58) Field of Classification Search
None
See application file for complete search history.

(56) References Cited

U.S. PATENT DOCUMENTS 5,274,955 A 1/1994 Dallaire et al.
5,783,909 A * 7/1998 Hochstein ..... H05B 33/0818 315/158

(Continued)

FOREIGN PATENT DOCUMENTS

CN 2690723 Y 4/2005
CN 2731252 Y 10/2005

(Continued)

OTHER PUBLICATIONS

U.S. Appl. No. 15/048,217, Zlotnikov et al.

(Continued)

*Primary Examiner* — Jany Richardson
(74) *Attorney, Agent, or Firm* — Winstead PC

(57) ABSTRACT

Systems and methods for maintaining the illumination intensity of one or more LEDs above a minimal intensity level. The systems and methods may include: (1) a current regulator for regulating the current in a circuit; (2) a voltage source for applying current to a circuit; (3) an LED with a minimal intensity level that correlates to a set-point temperature; and (4) a thermal sensor that is in proximity to the LED and adapted to sense a temperature proximal to the LED. The thermal sensor may transmit a signal to the current regulator if the sensed temperature exceeds the set-point temperature. Thereafter, the current regulator may take steps to regulate the current in order to maintain the LED illumination intensity above the minimal intensity level.

18 Claims, 7 Drawing Sheets

Related U.S. Application Data continuation of application No. 15/048,217, filed on Feb. 19, 2016, now Pat. No. 9,788,382, which is a continuation of application No. 13/119,786, filed as application No. PCT/US2009/058196 on Sep. 24, 2009, now Pat. No. 9,301,363.

(60) Provisional application No. 61/099,702, filed on Sep. 24, 2008.

(56) References Cited

U.S. PATENT DOCUMENTS

| | | | |
|---|---|---|---|
| 6,078,148 | A | 6/2000 | Hochstein |
| 6,094,292 | A | 7/2000 | Goldner et al. |
| 6,451,027 | B1 | 9/2002 | Cooper et al. |
| 6,747,420 | B2 | 6/2004 | Barth et al. |
| 6,786,625 | B2 | 9/2004 | Wesson |
| 6,803,732 | B2 | 10/2004 | Kraus et al. |
| 6,860,621 | B2 | 3/2005 | Bachl et al. |
| 6,870,325 | B2 | 3/2005 | Bushell et al. |
| 6,890,085 | B2 | 5/2005 | Hacker |
| 6,963,175 | B2 | 11/2005 | Archenhold et al. |
| 7,045,965 | B2 | 5/2006 | Li et al. |
| 7,059,731 | B2 | 6/2006 | Lee et al. |
| 7,067,995 | B2 | 6/2006 | Gunter et al. |
| 7,071,762 | B2 | 7/2006 | Xu et al. |
| 7,072,096 | B2 | 7/2006 | Holman et al. |
| 7,102,172 | B2 | 9/2006 | Lynch et al. |
| 7,108,396 | B2 | 9/2006 | Swaris et al. |
| 7,114,827 | B2 | 10/2006 | Halter |
| 7,125,142 | B2 | 10/2006 | Wainwright |
| 7,125,143 | B2 | 10/2006 | Hacker |
| 7,128,450 | B2 | 10/2006 | Tiesler et al. |
| 7,131,226 | B2 | 11/2006 | Gray et al. |
| 7,168,843 | B2 | 1/2007 | Striebel |
| 7,172,324 | B2 | 2/2007 | Wu et al. |
| 7,175,306 | B2 | 2/2007 | Pan |
| 7,198,387 | B1 | 4/2007 | Gloisten et al. |
| 7,221,104 | B2 | 5/2007 | Lys et al. |
| 7,276,861 | B1 | 10/2007 | Shteynberg et al. |
| 7,307,391 | B2 | 12/2007 | Shan |
| 7,391,162 | B2 | 6/2008 | Rohlfing et al. |
| 8,262,253 | B2 | 9/2012 | Zlotnikov et al. |
| 9,301,363 | B2 | 3/2016 | Zlotnikov et al. |
| 2002/0048168 | A1 | 4/2002 | Sejkora et al. |
| 2004/0032221 | A1 | 2/2004 | Bushell et al. |
| 2005/0260766 | A1 | 11/2005 | Paul et al. |
| 2005/0276053 | A1 | 12/2005 | Nortrup et al. |
| 2006/0026545 | A1 | 2/2006 | Allen et al. |
| 2006/0262544 | A1 | 11/2006 | Piepgras et al. |
| 2006/0262545 | A1 | 11/2006 | Piepgras et al. |
| 2006/0267028 | A1 | 11/2006 | Lynch et al. |
| 2007/0247842 | A1 | 10/2007 | Zampini et al. |
| 2007/0263393 | A1 | 11/2007 | Van De Ven |
| 2007/0291198 | A1* | 12/2007 | Shen ..... G09G 3/3413 349/69 |
| 2008/0061157 | A1 | 3/2008 | Grosskopf et al. |
| 2008/0215279 | A1 | 9/2008 | Salsbury et al. |
| 2012/0307494 | A1 | 12/2012 | Zlotnikov et al. |

FOREIGN PATENT DOCUMENTS

| | | | |
|---|---|---|---|
| CN | 1846459 | A | 10/2006 |
| DE | 10015759 | A1 | 10/2001 |
| DE | 10330261 | A1 | 1/2004 |
| DE | 102004026829 | A1 | 12/2005 |
| WO | WO-9736131 | A1 | 10/1997 |

OTHER PUBLICATIONS

Young, Lee W., International Search Report for PCT/US08/05689 dated Aug. 8, 2008 (3 pages).

Copenheaver. Blaine R., "International Search Report" for PCT/US2009/058196 dated Nov. 17, 2009, 2 pages.

* cited by examiner

METHODS AND SYSTEMS FOR MAINTAINING THE ILLUMINATION INTENSITY OF LIGHT EMITTING DIODES

RELATED APPLICATIONS

The present application is a continuation of U.S. patent application Ser. No. 15/698,207, filed on Sep. 7, 2017. U.S. patent application Ser. No. 15/698,207 is a continuation of U.S. patent application Ser. No. 15/048,217, filed on Feb. 19, 2016 (now U.S. Pat. No. 9,788,382). U.S. patent application Ser. No. 15/048,217 is a continuation of U.S. patent application Ser. No. 13/119,786, which entered the national stage in the U.S. on Mar. 18, 2011 (now U.S. Pat. No. 13/119,786). U.S. patent application Ser. No. 13/119,786 is a national stage of PCT/US2009/058196. PCT/US2009/058196 claims priority to U.S. Provisional Patent Application No. 61/099,702, filed on Sep. 24, 2008. U.S. patent application Ser. No. 15/698,207, U.S. patent application Ser. No. 15/048,217, U.S. patent application Ser. No. 13/119,786, U.S. Provisional Patent Application No. 61/099,702, and PCT/US2009/058196 are incorporated herein by reference.

TECHNICAL FIELD

This present invention relates generally to light sources and more particularly, but not by way of limitation, to methods and systems for maintaining the illumination intensity of Light Emitting Diodes (LEDs).

HISTORY OF RELATED ART

In some LEDs, illumination intensity drops as LED junction temperature rises. However, for many applications, a drop in LED illumination intensity below a minimal threshold is not acceptable. For example, Federal Aviation Administration Regulations (FARs) require that position lights on aircraft always emit light greater than a specified minimum intensity. In fact, an LED light that operates below a specified intensity level may completely shut down profitable operations or even cause hazardous conditions. For instance, navigation lights on an aircraft must operate at a specified intensity in order for the aircraft to be operable in a safe manner.

SUMMARY

In some embodiments, circuits for maintaining the illumination intensity of an LED above a minimal intensity level are provided. The circuits may generally comprise: (1) a current regulator for regulating the current in the circuit; (2) a voltage source for applying current to the circuit; (3) an LED with a minimal intensity level that correlates to a set-point temperature; and (4) a thermal sensor that is in proximity to the LED. The thermal sensor may be adapted to sense a temperature proximal to the LED, such as the LED junction temperature. The thermal sensor may also be adapted to transmit a signal to the current regulator if the sensed temperature exceeds the set-point temperature. Thereafter, the current regulator may take steps to regulate the current in order to maintain the LED illumination intensity above the minimal intensity level.

In other embodiments, methods are provided for maintaining the illumination intensity of an LED above a minimal intensity level. The methods generally comprise (1) using a thermal sensor to sense a temperature proximal to the LED, such as the LED junction temperature; (2) determining whether the sensed temperature exceeds a set-point temperature that correlates to the LEDs minimal intensity level; and (3) applying current to the LED if the sensed temperature exceeds the set-point temperature. In some embodiments, the above-mentioned steps may be repeated if the sensed temperature is at or below the set-point temperature.

In some embodiments, the applied current may be derived from a voltage source. In some embodiments, the application of current to the LED may comprise: (1) transmission of a first signal from the thermal sensor to a current regulator; (2) transmission of a second signal from the current regulator to the voltage source in response to the first signal; and (3) application of current to the LED by the voltage source in response to the second signal. In some embodiments, the application of current may comprise increasing the current that is applied to the LED. In some embodiments, the application of current may comprise increasing the voltage and/or decreasing the resistance of a circuit that is associated with the LED.

Various embodiments may provide one, some, or none of the above-listed benefits. Such aspects described herein are applicable to illustrative embodiments and it is noted that there are many and various embodiments that can be incorporated into the spirit and principles of the present invention. Accordingly, the above summary of the invention is not intended to represent each embodiment or every aspect of the present invention.

BRIEF DESCRIPTION OF THE DRAWINGS

A more complete understanding of the methods and apparatus of the present invention may be obtained by reference to the following Detailed Description when taken in conjunction with the accompanying Drawings, wherein.

DETAILED DESCRIPTION

Figure 1:
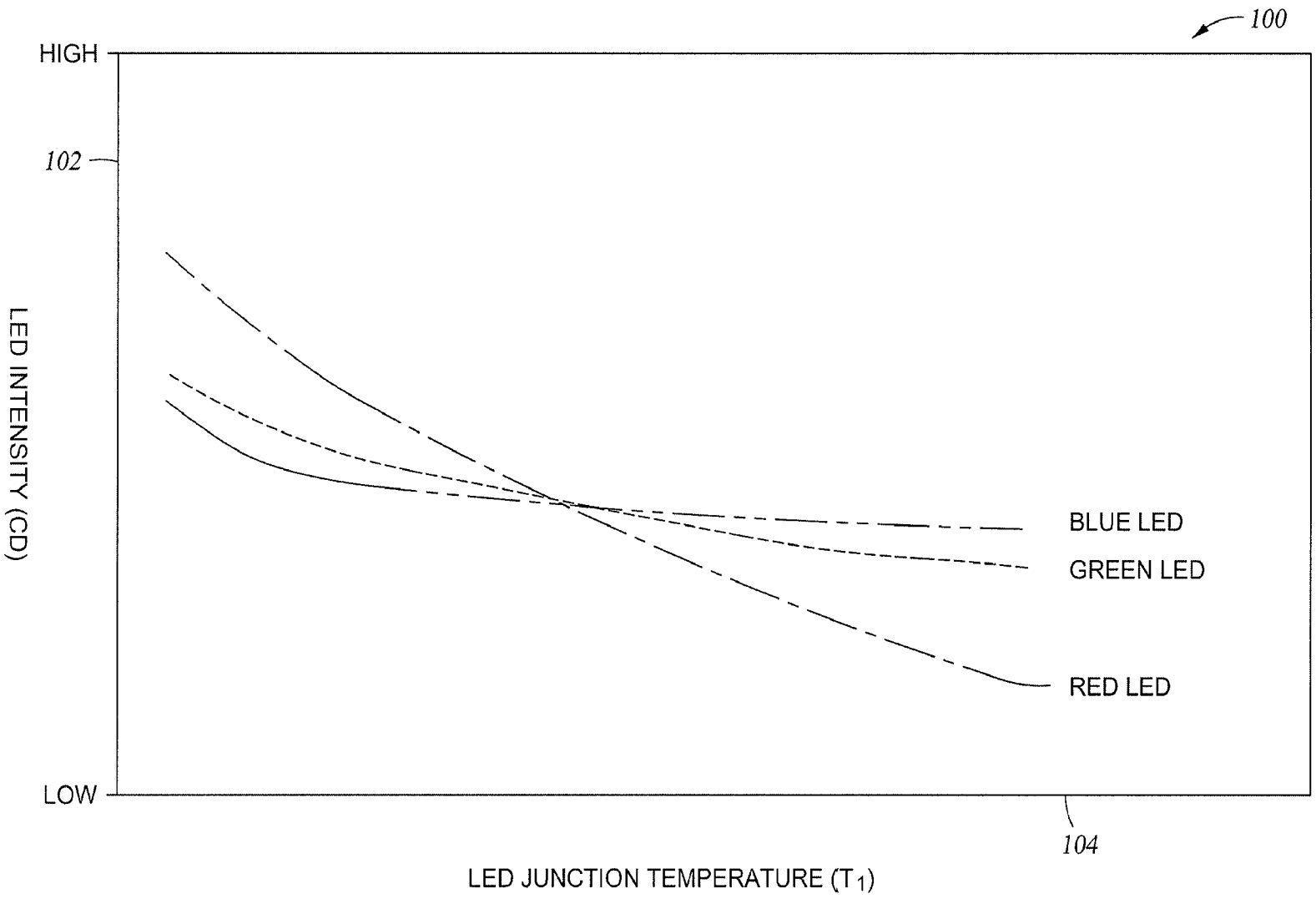
FIG. 1 is a graph of LED intensity (cd) relative to LED junction temperature ($T_J$)

To maintain the illumination intensity of an LED at a specified minimum level, many systems and methods have applied a constant and excessive level of current to the LED. The rationale for such an approach is to ensure that, when the LED junction temperature rises, a corresponding drop in the illumination intensity of the LED does not fall below a specified minimum intensity. However, the application of the excessive current to the LED during periods when the LED junction temperature is low can shorten the operating life of the LED.

In many applications, significant manpower, equipment, and financial resources may be required to replace LEDs on a frequent basis due to the shortened lifetime. Furthermore, frequent LED replacements may interfere with commercial operations and profitability. Accordingly, there is currently a need for improved methods and systems for maintaining the illumination intensity of an LED above a minimal intensity level without the need to apply constant excessive current.

Reference is now made in detail to illustrative embodiments of the invention as shown in the accompanying drawings. Wherever possible, the same reference numerals are used throughout the drawings to refer to the same or similar parts.

In accordance with one aspect of the invention, methods and systems are provided for maintaining an illumination intensity of an LED above a desired minimal intensity level as a temperature that is associated with the LED (e.g., an LED junction temperature) increases. A Graph 100 depicted in FIG. 1 illustrates a need for the improved systems and methods. In particular, the graph 100 shows the effects of increasing LED junction temperatures ($T_j$) on the intensities (cd) of differently colored LEDs (blue, green and red). The vertical axis of the graph 100 represents LED intensity (cd) 102, while the horizontal axis represents an LED junction temperature ($T_j$) 104. The graph 100 generally shows that, for all the differently colored LEDs, as the LED junction temperature 104 increases, the LED intensity 102 decreases.

Figure 2:
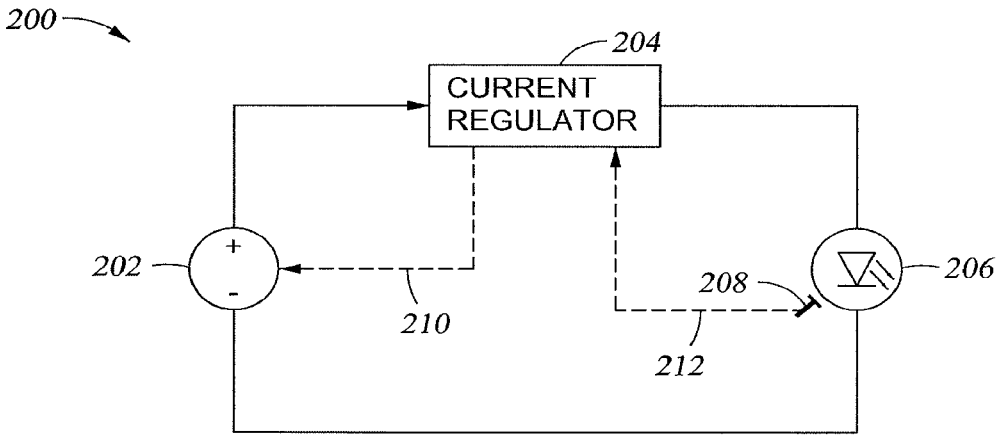
FIG. 2 is a diagram of a circuit that includes an LED.

In some embodiments, circuits are provided that can maintain the illumination intensity of an LED above a minimal intensity level as an LED-associated temperature increases. As an example, FIG. 2 is a diagram of a circuit 200 that includes a voltage source 202, a current regulator 204, an LED 206 arranged in series, and a thermal sensor 208 in proximity to the LED 206.

In the circuit 200, the LED 206 is in proximity to the thermal sensor 208. As also shown in FIG. 2, the thermal sensor 208 is adjacent to the LED 206 at an LED junction. In addition, the thermal sensor 208 is connected to the current regulator 204 through a feedback loop 212. However, in other embodiments, the thermal sensor 208 may be positioned at different locations relative to the LED 206. Similarly, the voltage source 202 and the current regulator 204 are connected to one another through a feedback loop 210. A person of ordinary skill in the art will recognize that the above-mentioned circuit components can have different arrangements in other embodiments.

As discussed in more detail below, the circuit 200 has various modes of operation. For instance, in some embodiments, the thermal sensor 208 can transmit a first signal to the current regulator 204 through the feedback loop 212 if a sensed temperature exceeds a desired temperature that correlates to a minimal intensity level for the LED 206. In response to the first signal from the thermal sensor 208, the current regulator 204 may then transmit a second signal to the voltage source 202 through the feedback loop 210. Next, and in response to the second signal, the voltage source 202 may cause the current that is applied to the LED 206 to increase. As a result, the increased current will maintain the illumination intensity of the LED 206 above the minimal intensity level.

The LED 206 operates at an illumination intensity level that is responsive to an current applied to the LED 206. The LED 206 may have associated therewith a desired minimal illumination intensity level (i.e., minimal intensity level). The minimal intensity level may be dictated by federal regulations, such as Federal Aviation Administration Regulations (FARs). The minimal intensity level may also be dictated or recommended by regulatory agencies and/or industry standards. In other embodiments, the minimal intensity level may be derived, for example, from an industry custom, design criteria, or an LED user's personal requirements.

The illumination intensity level of the LED 206 can be correlated to a temperature associated with the LED 206, such as a pre-defined LED junction temperature. For instance, the LED 206 may be associated with a set-point temperature that correlates to the desired minimal intensity level of the LED 206. Accordingly, the sensing of temperatures above the set-point temperature can indicate that the intensity of the LED 206 is less than the minimal intensity level.

The circuit 200 shown in FIG. 2 only contains the single LED 206. However, and as will be discussed in more detail below, other embodiments may include a plurality of LEDs. In some embodiments, the LEDs may be proximate or adjacent to one another. In some embodiments, the LEDs may be physically or electrically grouped. For instance, in some embodiments that utilize a plurality of LEDs, one or more of the plurality of LEDs may be associated with an applied current from a different voltage source. In other embodiments, the current may be applied to a grouping of LEDs from a single voltage source.

The thermal sensor 208 is typically adapted to sense a temperature in a location proximal to the LED 206, such as the LED junction temperature. In some embodiments, the thermal sensor 208 may be a temperature-measurement device that can measure the LED 206 junction temperature directly. In other embodiments, the thermal sensor 208 may derive the LED 206 junction temperature by measuring the temperature of one or more areas near the LED 206.

In some embodiments, the thermal sensor 208 may be a thermal switch that activates and sends a signal to the current regulator 204 at or near the set-point temperature. In other embodiments, the thermal sensor 208 may sense and transmit one or more signals in response to a range of temperatures. In other embodiments, the thermal sensor 208 may be a thermal switch as well as a temperature-measuring device. As will be discussed in more detail below, the transmitted signals can then be used to increase the current in the circuit 200 in order to maintain the illumination intensity of the LED 206 above the minimal intensity level.

Figure 3A:
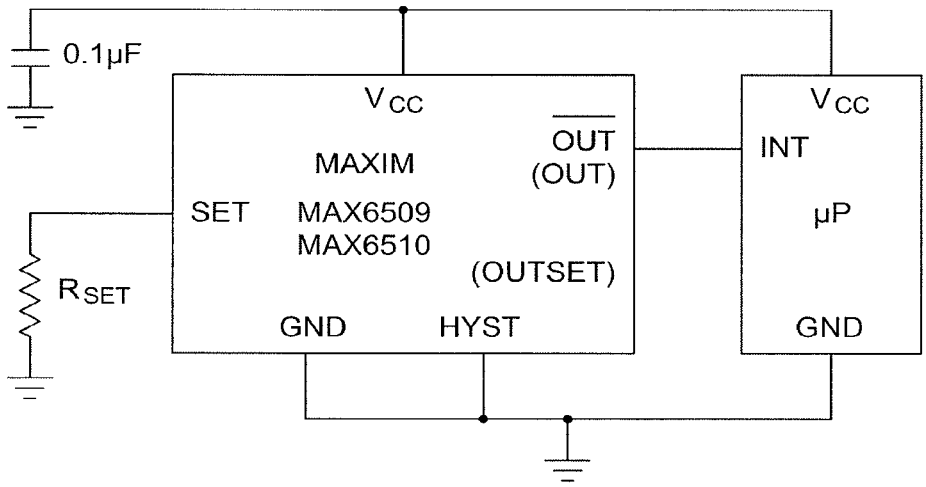
FIG. 3A illustrates an operating circuit of a thermal sensor.
Figure 3B:
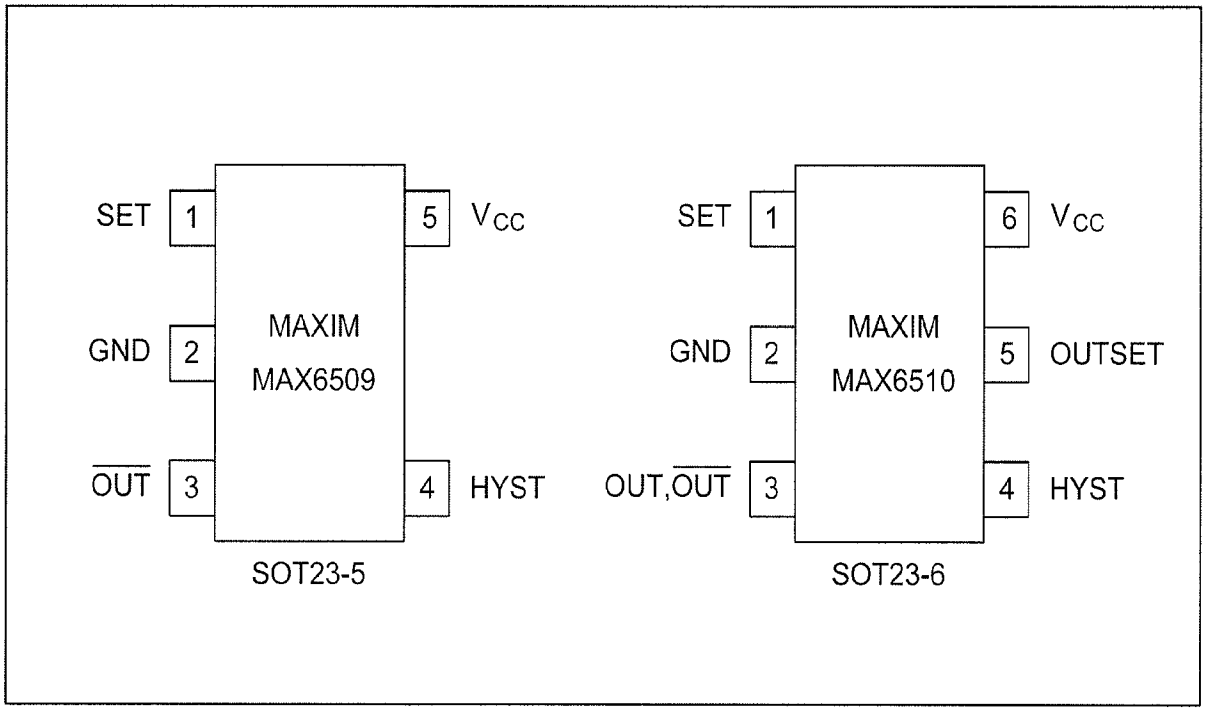
FIG. 3B illustrates a pin configuration of a thermal sensor.

In some embodiments, the thermal sensor 208 can be a resistor-programmable SOT switch (or switches). The resistor-programmable SOT switch, by way of example, may be a MAXIM MAX/6510 Resistor-Programmable SOT Temperature Switch that is available from Maxim Integrated Products of Sunnyvale, Calif. FIGS. 3A-B depict typical operating circuit and pin configurations for the MAXIM temperature switches.

In some embodiments, the thermal sensor 208 may be in proximity to a plurality of LEDs. In the embodiments, the thermal sensor 208 may sense a temperature that is proximal to the plurality of LEDs. In other embodiments, a circuit may include a plurality of thermal sensors. In those embodiments, one or more of the plurality of the thermal sensors may be in proximity to a single LED or a plurality of LEDs for sensing a temperature that is proximal thereto.

Referring again to FIG. 2, the voltage source 202 may be implemented in various embodiments. For instance, in some embodiments, the voltage source 202 may be a battery. In other embodiments, the voltage source 202 may include a capacitor or a voltage divider. In other embodiments, the voltage source 202 may be a device that produces an electromotive force. In other embodiments, the voltage source 202 may be another form of device that derives a secondary voltage from a primary voltage source. Additional embodiments of voltage sources can also be envisioned by a person of ordinary skill in the art.

The current regulator 204 may also exist in various embodiments. For instance, in some embodiments, the current regulator 204 may be a voltage regulator. In other embodiments, the current regulator 204 may include a potentiometer. In some embodiments, the current regulator 204 may include resistance-varying devices that are responsive to, for example, a signal from the thermal sensor 208. Other current regulators may also be envisioned by persons of ordinary skill in the art.

The circuit 200 shown is only an example of a circuit that may be used to maintain the illumination intensity of an LED above a minimal intensity level. As will be described in more detail below, and as known by a person of ordinary skill in the art, other circuits with different arrangements may also be utilized to practice various embodiments of the present invention. For instance, in some embodiments, a circuit may include a plurality of LEDs that are attached to a printed wiring assembly (PWA). In other embodiments, a circuit may include a thermal pad or other thermal conductor to remove heat from the PWA. In some embodiments, the thermal pad may include copper. In additional embodiments, a circuit may include a plurality of LEDs that are associated with a common heat sink.

Figure 4:
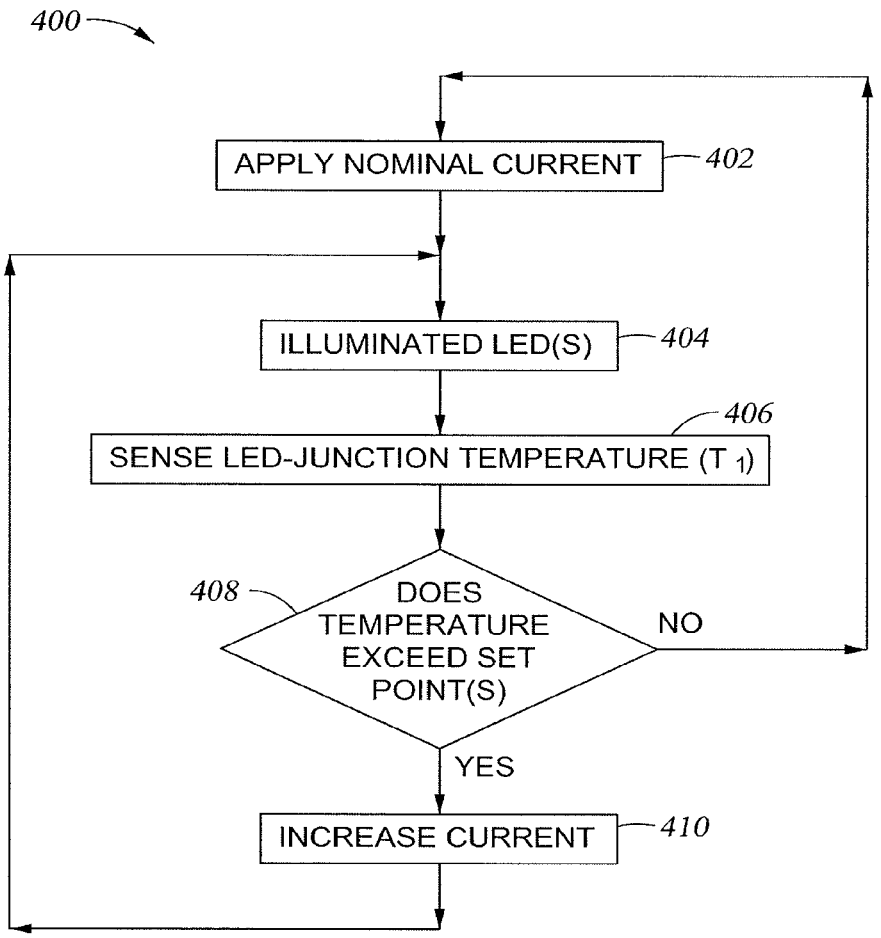
FIG. 4 is a flow chart depicting a method of maintaining illumination intensity of an LED above a minimal intensity level.

Various methods can be used to maintain the illumination intensity of an LED above a minimal intensity level. A process 400 depicted in FIG. 4 illustrates one method of illumination control. Flow chart 400 begins at step 402, at which step nominal current is applied to a circuit, such as, for example, the circuit 200. From step 402, execution proceeds to step 404. At step 404, the applied nominal current illuminates an LED (e.g., the LED 206 in FIG. 2). Thereafter, at step 406, a thermal sensor (e.g., the thermal sensor 208 in FIG. 2) senses an LED junction temperature ($T_j$). Next, at step 408, a determination is made whether the $T_j$ sensed at step 406 exceeds an established set-point temperature. If the $T_j$ sensed at step 406 does not exceed the set-point temperature (i.e., if $T_j$ is at or below the set-point temperature), the process 400 returns to step 402. However, if the $T_j$ sensed at step 406 exceeds the set-point temperature, execution proceeds to step 410. At step 410, the current supplied to the LED is increased to compensate for the increase in the temperature. From step 410, execution returns to step 404.

A person of ordinary skill in the art will recognize that the process flow 400 may exist in numerous embodiments. For instance, in some embodiments, a thermal sensor (e.g., thermal sensor 208 in FIG. 2) may also perform the determination step 408. However, in other embodiments, another device, such as a separate processor, may perform the determination step 408. In some embodiments, the nominal current applied in step 402 may be on the order of approximately 165-215 mA. In some embodiments, the increased current level resurging from step 410 may be on the order of approximately 260-330 mA. In some embodiments, the current regulation can be stepped (as will be described in more detail in connection with FIG. 5). In various embodiments, the current regulation can vary within a pre-defined range.

In some embodiments, various steps depicted in FIG. 4 may be performed, for example, by one or more of the components of the circuit 200, as illustrated in FIG. 2. For instance, in some embodiments, the thermal sensor 208 may sense a temperature proximal to the LED 206, such as the LED 206 junction temperature. The thermal sensor 206 may then transmit a first signal to the current regulator 204 through the feedback loop 212 if the thermal sensor 206 determines that the sensed temperature exceeds the set-point temperature. In response, the current regulator 204 may send a second signal through the feedback loop 210 to the voltage source 202. The voltage source 202 may then cause the current applied to the LED 206 to increase in response to the second signal. As a result, the LED 206 can maintain its illumination intensity above a desired minimal intensity level. Furthermore, the above-mentioned steps may be repeated if the sensed temperature is at or below the set-point temperature.

In addition to directly increasing the current, other methods may be used to maintain the illumination intensity of an LED above a desired minimal intensity level. For instance, the methods may include, but are not necessarily limited to: (1) decreasing the resistance of a current regulator (e.g., the current regulator 204 in FIG. 2) or another component in series with an LED (e.g., the LED 206 in FIG. 2); (2) increasing resistance in parallel with an LED (e.g., the LED 206 in FIG. 2); (3) increasing the voltage supplied by a voltage source (e.g., the voltage source 202 in FIG. 2); or (4) some combination of (1)-(3).

In various embodiments, the voltage and the current in an LED circuit are closely coupled. For instance, in some embodiments, a typical LED may be a current device that requires a certain applied voltage in order to maintain a given level of light output. In the embodiment, the LED circuit may alter the value of a resistor in a control loop. This change in resistance may then cause the control voltage to change. Therefore, in these embodiments, current in the control loop changes in order to compensate for the change in control voltage.

Figure 5:
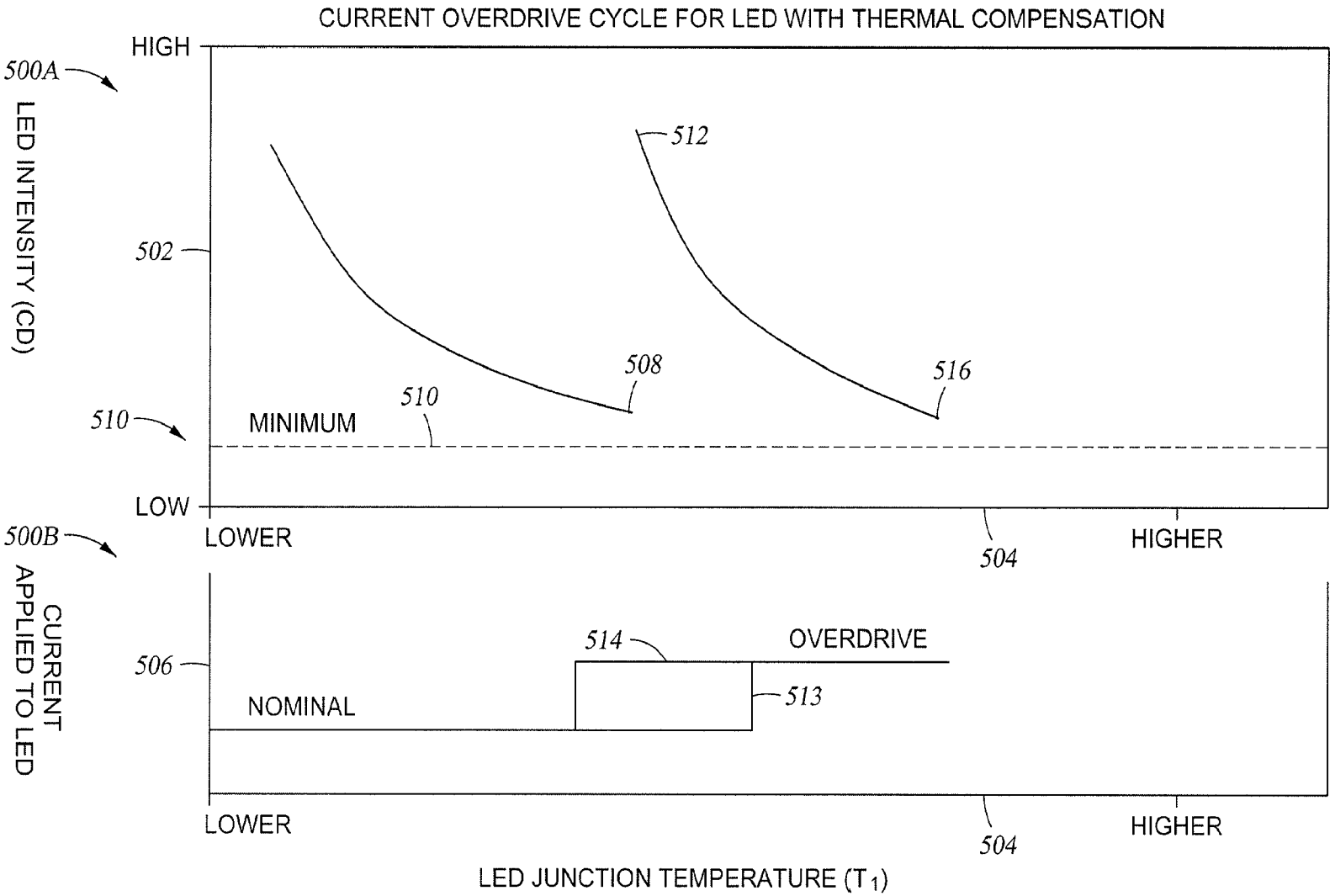
FIG. 5 shows two associated graphs that illustrate a relationship between LED junction temperature, LED intensity (upper panel), and current applied to the LED (lower panel)

FIG. 5 shows two linked graphs that illustrate how an LED illumination intensity can be maintained above a minimal intensity level in some embodiments. The vertical axis of graph 500A represents an LED intensity (cd) 502. The horizontal axes of graphs 500A and 500B represent an LED junction temperature ($T_j$) 504. The vertical axis of graph 500B represents a current applied to an LED 506. As the value of $T_j$ increases, the LED intensity 502 falls and approaches $cd_1$ 508, which represents a minimal illumination intensity level 510. As $cd_1$ 508 is approached, the LED intensity 502 is increased to $cd_2$ 512 by increasing the current applied from a nominal value up to an overdrive current value 514. A current hysteresis 513 is used to avoid undesirable switching between the two current values.

In the illustrated embodiment, if $T_j$ continues to increase such that the LED intensity 502 descends again to approach $cd_3$ 516, (i.e., again approaching the minimal illumination intensity level 510), the current applied to the LED 506 can be raised to a second overdrive current value (not shown) that is greater than the overdrive current value 514 in order to raise the LED intensity 502 to an acceptable level. In a typical embodiment, the current applied to the LED 506 may not be increased beyond a maximal current level. The maximal current level is typically set in order to avoid, for example, a thermal runaway condition that could cause system damage. In a typical embodiment, applied current may be increased only to the maximal level responsive to LED intensity approaching the minimal illumination intensity level 510.

The methods shown in FIG. 5 can also exist in various embodiments. For instance, in some embodiments, current regulation may be achieved in the steps depicted in the graphs 500A and 500B. In other embodiments, the current regulation can be modulated over a range.

Figure 6:
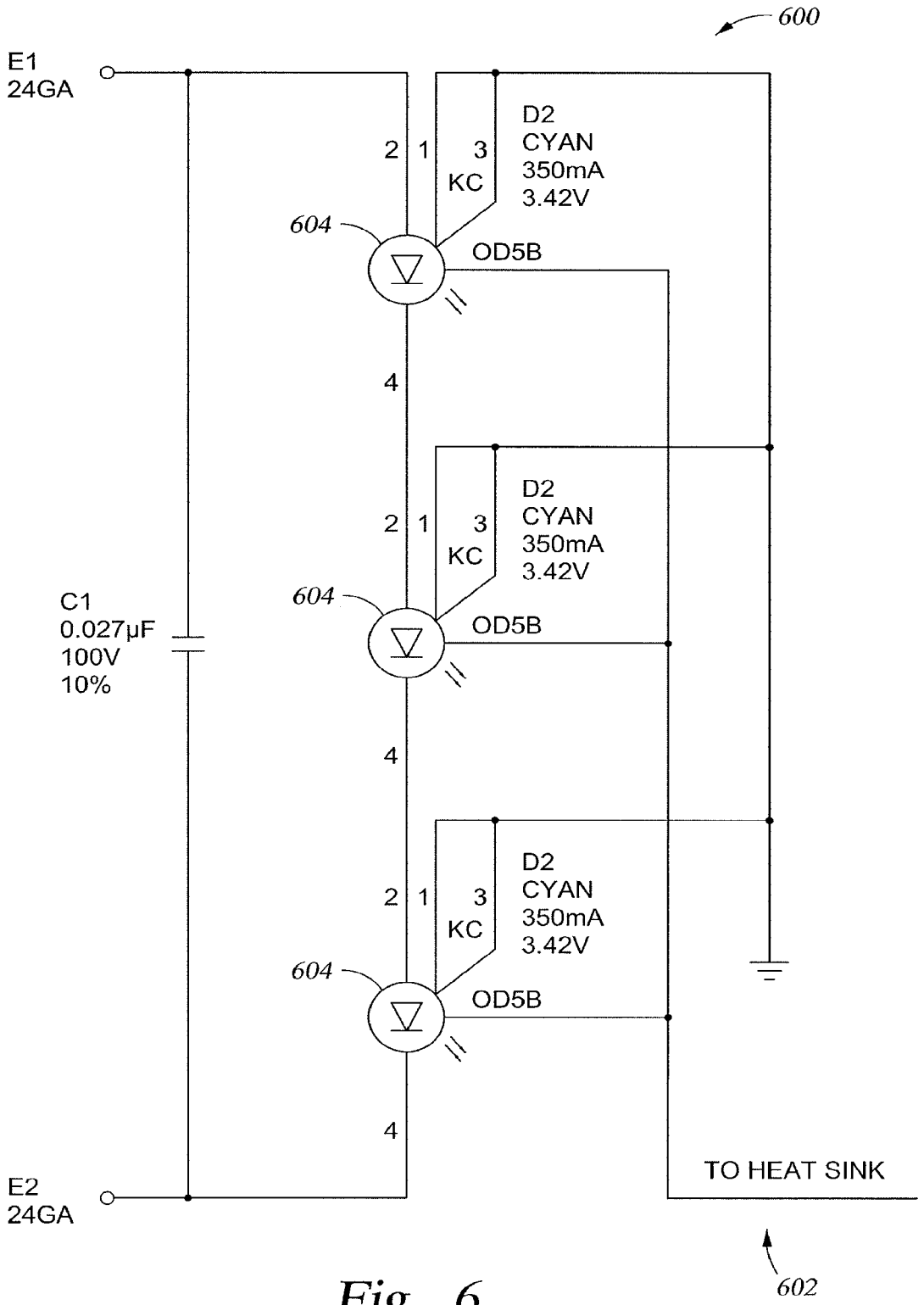
FIG. 6 is a diagram of a circuit that includes a grouping of LEDs that share a common heat sink.

FIG. 6 is a diagram of a circuit 600 that includes a plurality of LEDs 604 that share a common heat sink 602. In some embodiments, more than one heat sink temperature value may be sensed by a single thermal sensor. In some embodiments, the temperature of one or more LED heat sinks may be sensed via a thermal connection, for example, to a case holding an LED.

Figure 7:
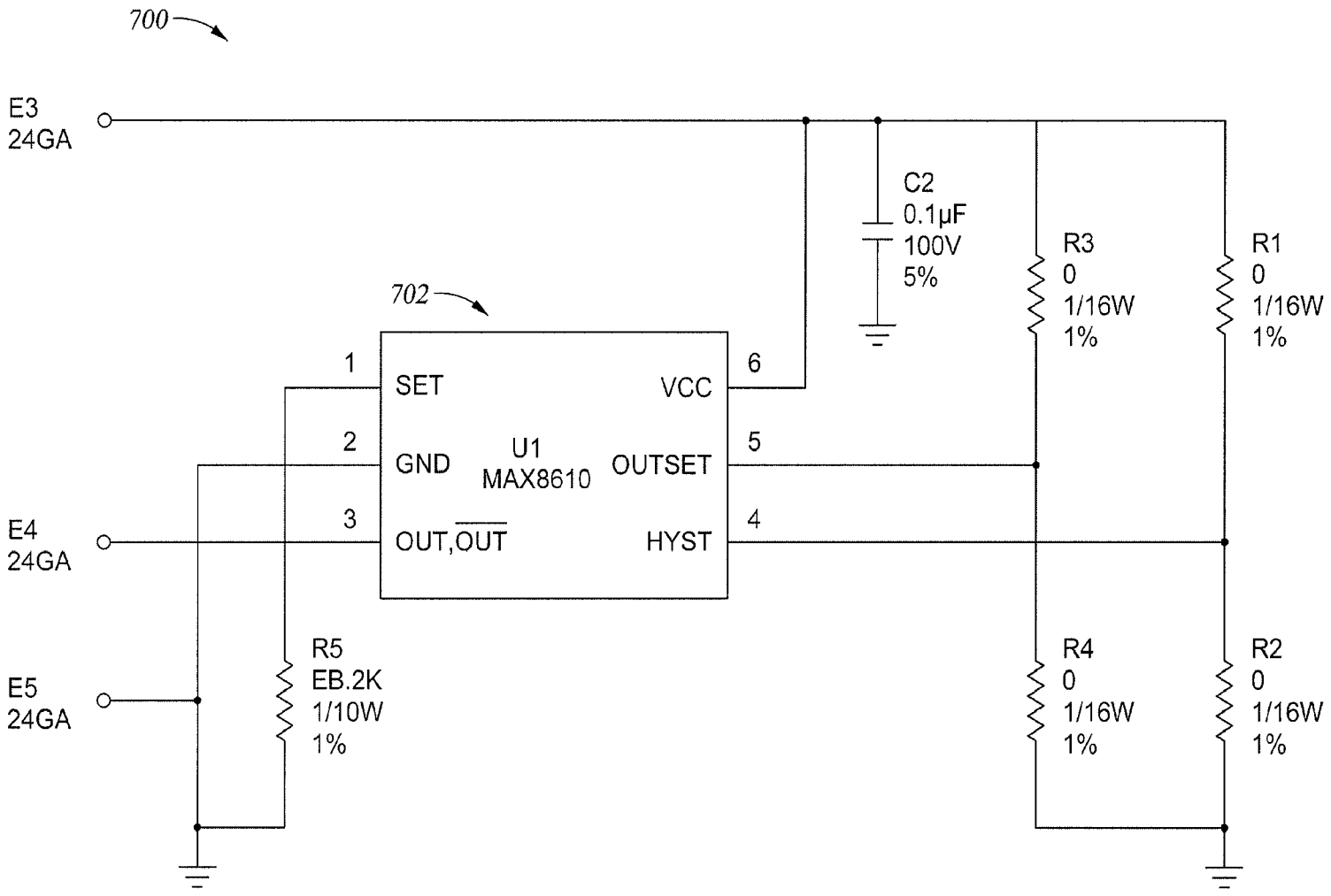
FIG. 7 is a diagram of a circuit that includes a thermal sensor.

FIG. 7 is a diagram of another circuit 700 that can be used to practice the methods of the present invention. In this embodiment, a temperature-sensing device 702 may be located physically close to an LED grouping in order to facilitate accurate sensing of an LED junction temperature. In this embodiment, the temperature set-point may have to be adjusted according to the particular temperature being sensed.

The methods and systems of the present invention can substantially eliminate or reduce disadvantages and problems associated with previous systems and methods. For instance, in some embodiments, the ability to operate an LED with variable current based on the LED junction temperature may extend the operating life of the LED. This may in turn reduce significant manpower, equipment, and financial resources that may be required to replace LEDs on a frequent basis.

The methods and systems of the present invention may also have numerous applications. For instance, in some embodiments, the methods and systems of the present invention may be used to maintain the illumination intensity of navigation lights of an aircraft above a federally-mandated minimal intensity level. In other similar embodiments, the methods and systems of the present invention may be used to maintain the illumination intensity of LEDs in automobiles, trains, or boats. Other applications of the present invention can also be envisioned by a person of ordinary skill in the art.

Although various embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit and scope of the invention as defined by the appended claims.

What is claimed is:

1. A circuit comprising:

a voltage source;

a light-emitting diode (LED) having a desired minimal intensity level associated therewith, the desired minimal intensity level being correlated to a pre-defined LED set-point temperature;

a thermal sensor in proximity to the LED and adapted to sense a temperature proximal to the LED;

a current regulator interoperably coupled to the voltage source, the thermal sensor, and the LED;

wherein, responsive to a sensed temperature greater than the pre-defined LED set-point temperature, current supplied to the LED is increased in a step-wise manner from an original current level to an increased current level; and wherein, responsive to a sensed temperature less than a second pre-defined LED temperature, current supplied to the LED is decreased in a step-wise manner from the increased current level to the original current level, the second pre-defined LED temperature being less that the pre-defined LED set-point temperature.

2. The circuit of claim 1, wherein the thermal sensor comprises a resistor programmable SOT temperature switch.

3. The circuit of claim 1, wherein the thermal sensor is positioned adjacent an LED junction of the LED.

4. The circuit of claim 1, wherein the thermal sensor senses an LED-junction temperature.

5. The circuit of claim 1, wherein the circuit comprises a plurality of LEDs.

6. The circuit of claim 5, wherein the thermal sensor is positioned in proximity to the plurality of LEDs and senses a temperature proximal to the plurality of LEDs.

7. The circuit of claim 5, comprising:

a plurality of thermal sensors; and wherein each of the plurality of thermal sensors is positioned in proximity to an LED of the plurality of LEDs and senses a temperature proximal to the LED.

8. The circuit of claim 1, wherein the voltage source is a battery.

9. The circuit of claim 1, wherein the current regulator comprises a potentiometer.

10. A method comprising:

sensing, via a thermal sensor, a temperature proximal to the LED;

determining whether a sensed temperature exceeds a pre-defined set-point temperature that correlates to a minimal intensity level of the LED;

responsive to a determination that the sensed temperature exceeds the pre-defined set-point temperature, transmitting a first signal from the thermal sensor to a current regulator;

transmitting a second signal from the current regulator to a voltage source in response to the first signal; and increasing, in a step-wise manner, current level applied to the LED from a nominal level to an increased current level;

responsive to a determination that the sensed temperature is less than a second pre-defined temperature, transmitting a third signal from the thermal sensor to the current regulator, the second pre-defined temperature being less than the pre-defined set-point temperature;

transmitting a fourth signal from the current regulator to the voltage source in response to the third signal; and decreasing, in a step-wise manner, current level applied to the LED from the increased current level to the nominal current level.

11. The method of claim 10, wherein the steps of claim 10 are repeated if the sensed temperature is determined to be not greater than the pre-defined set-point temperature.

12. The method of claim 10, wherein the increasing-current step causes an LED illumination intensity to be not less than the minimal intensity level.

13. The method of claim 10, wherein an increased current is in the range of about 260 mA to about 330 mA.

14. The method of claim 10, wherein the increasing-current step comprises increasing a voltage supplied a voltage source of a circuit associated with the LED.

15. The method of claim 10, wherein the increasing-current step comprises decreasing a resistance of a circuit associated with the LED.

16. The method of claim 10, wherein the sensing step comprises the thermal sensor sensing an LED junction temperature.

17. The method of claim 10, wherein the determining step is performed by the thermal sensor.

18. A circuit comprising:

a voltage source;

a light-emitting diode (LED) having a desired minimal intensity level associated therewith, the desired minimal intensity level being correlated to a pre-defined LED set-point temperature;

a thermal sensor in proximity to the LED and adapted to sense a temperature proximal to the LED, the thermal sensor comprises a switch adapted to activate responsive to the pre-defined LED set-point temperature being exceeded, the activation of the switch results in transmission of a signal to the current regulator;

a current regulator interoperably coupled to the voltage source, the thermal sensor, and the LED;

wherein, responsive to a sensed temperature greater than the pre-defined LED set-point temperature, current supplied to the LED is increased in a step-wise manner from an original current level to an increased current level; and wherein, responsive to a sensed temperature less than a second pre-defined LED temperature, current supplied to the LED is decreased in a step-wise manner from the increased current level to the original current level, the second pre-defined LED temperature being less that the pre-defined LED set-point temperature.

* * * * *